US007128157B2

(12) United States Patent
Hoffman et al.

(10) Patent No.: US 7,128,157 B2
(45) Date of Patent: Oct. 31, 2006

(54) METHOD AND APPARATUS FOR TREATING A WELL

(75) Inventors: Corey E. Hoffman, Magnolia, TX (US); Robert Murphy, Montgomery, TX (US)

(73) Assignee: Weatherford/Lamb, Inc., Houston, TX (US)

( * ) Notice: Subject to any disclaimer, the term of this patent is extended or adjusted under 35 U.S.C. 154(b) by 213 days.

(21) Appl. No.: 10/616,455

(22) Filed: Jul. 9, 2003

(65) Prior Publication Data

US 2005/0006098 A1 Jan. 13, 2005

(51) Int. Cl.
*E21B 43/12* (2006.01)

(52) U.S. Cl. ..... 166/305.1; 166/297; 166/115

(58) Field of Classification Search ..... 166/305.1, 166/116, 191, 192, 135, 115
See application file for complete search history.

(56) References Cited

U.S. PATENT DOCUMENTS 3,642,064 A * 2/1972 Rosenthal ..... 166/134
4,372,393 A * 2/1983 Baker ..... 166/382
5,704,426 A * 1/1998 Rytlewski et al. ..... 166/297
6,056,055 A 5/2000 Falconer et al.
6,186,236 B1 2/2001 Cox
6,253,856 B1 7/2001 Ingram et al.
6,394,184 B1 * 5/2002 Tolman et al. ..... 166/281
6,457,532 B1 * 10/2002 Simpson ..... 166/380
2002/0162660 A1 11/2002 Depiak et al.
2002/0195248 A1 12/2002 Ingram et al.

OTHER PUBLICATIONS

EP Search Report, Application No. EP 04103216, dated Feb. 2, 2005.

* cited by examiner

*Primary Examiner*—Frank Tsay
(74) *Attorney, Agent, or Firm*—Patterson & Sheridan, LLP

(57) ABSTRACT

The present invention generally relates to a method and an apparatus for stimulating the production of an existing well. In one aspect, a method of treating a well is provided. The method includes inserting a selective treatment assembly and a plug assembly into a partially lined wellbore until the selective treatment assembly is positioned proximate an area of interest. Thereafter, the selective treatment assembly is activated to isolate and treat the area of interest. Next, the selective treatment assembly is deactivated and urged toward the surface of the well until the plug assembly is seated in a polished bore receptacle disposed in a string of casing. At this point, the treated portion of the wellbore is separated from the untreated portion. Thereafter, the pressure in the untreated portion of the wellbore is equalized with the surface of the well and then the selective treatment assembly is removed from the wellbore while the plug assembly remains in the polished bore receptacle. Next, a string of production tubing is disposed in the wellbore and attached to the polished bore receptacle. The plug assembly is then removed from the polished bore receptacle and the well is produced. In another aspect an apparatus for treating a portion of a wellbore is provided.

23 Claims, 7 Drawing Sheets

METHOD AND APPARATUS FOR TREATING A WELL

BACKGROUND OF THE INVENTION

1. Field of the Invention

The present invention generally relates to a method and an apparatus for increasing the productivity of an existing well. More particularly, the invention relates to treating a portion of the existing well to stimulate production.

2. Description of the Related Art

In the drilling of oil and gas wells, a wellbore is formed using a drill bit that is urged downwardly at a lower end of a drill string. After drilling a predetermined depth, the drill string and bit are removed, and the wellbore is lined with a string of steel pipe called casing. The casing provides support to the wellbore and facilitates the isolation of certain areas of the wellbore adjacent hydrocarbon bearing formations. The casing typically extends down the wellbore from the surface of the well to a designated depth. An annular area is thus defined between the outside of the casing and the earth's formation. This annular area is filled with cement to permanently set the casing in the wellbore and to facilitate the isolation of production zones and fluids at different depths within the wellbore.

Historically, wells have been drilled with a column of fluid in the wellbore designed to overcome any formation pressure encountered as the wellbore is formed. This "overbalanced condition" restricts the influx of formation fluids such as oil, gas. or water into the wellbore. Typically, well control is maintained by using a drilling fluid with a predetermined density to maintain a hydrostatic pressure in the wellbore at a higher pressure than a formation pressure. In the overbalanced condition, formation damage may occur as the hydrostatic pressure forces the drill cuttings, and "fines" into the formation. Additional damage occurs if the drilling fluid flows into the formation. This flow of fluid into the formation can cause pores in the formation to become obstructed with drilling fluid and associated particulate matter. That obstruction can decrease formation permeability. Additionally, the cuttings or other solids form a wellbore "skin" along the interface between the wellbore and the formation. The wellbore skin restricts the flow of the formation fluid and thereby damages the well.

One method of addressing the damage to the wellbore or the lowered productivity of the well as described above is with some form of hydraulic fracturing treatment such as an "acid frac" operation. In the acid frac operation, an acid, such as hydrochloric acid, is used in a formation to etch open faces of induced fractures and natural fractures. When the treatment is complete, the fracture closes and the etch surfaces provide a high conductivity path from the formation to the wellbore. In some situations, small sized particles are mixed with fracturing fluid to hold fractures open after the hydraulic fracturing treatment. This is known in the industry as prop and frac. In addition to the naturally occurring sand grains, man made or specially engineered proppants, such as resin coated sand or high strength ceramic material, may also be used to form the fracturing mixture used to "prop and frac". Proppant materials are carefully sorted for size and sphericity to provide an effective means to prop open the fractures, thereby allowing fluid from the formation to enter the wellbore.

The hydraulic fracturing treatment may be employed both in a wellbore lined with casing and an open hole wellbore. Generally, if the wellbore is lined with casing, a perforating gun is used prior the fracturing treatment to form a fluid path between the formation and the interior of the wellbore. The perforating gun is a device used to perforate the casing of an oil or gas well at an area of interest. Preferably, the perforating gun is located at a desired location adjacent a formation and then is activated by triggering a series of explosive charges to perforate the casing, thereby forming the fluid path between the formation and the casing. Thereafter, the perforating gun is typically moved to another area of interest where treatment is desired and subsequently removed from the wellbore after each area of interest is perforated.

After the fluid path between the formation and the casing is established, fracturing fluid, such as a specially engineered fluid, is pumped at high pressure and rate into the formation being treated, thereby causing the fracture to open. For example, the wings of a vertical fracture extend away from the wellbore in opposing directions according to the natural stresses within the formation. As previously discussed, proppants, such as grains of sand of a particular size, are mixed with the fracturing fluid to keep the fracture open after the treatment is complete. In this manner, hydraulic fracturing creates high-conductivity communication with a large area of formation and bypasses any damage that may exist in the near-wellbore area and increases productivity.

One problem associated with using the hydraulic fracturing treatment relates to damaging the treated area after the hydraulic fracturing treatment is complete. For instance, the vertical portion of the wellbore is typically filled with fluid to maintain well control before the fracturing equipment is removed from the wellbore. However, the fluid in the vertical portion creates a hydrostatic head due to the density of the fluid which will typically force existing wellbore fluid into the newly formed fractures and thus "killing" the well by stopping the flow of formation fluid or by restricting the formation fluid flow into the wellbore. Another problem arises due to the cost of the operation. For instance, the fracturing fluid is expensive and the volume required to treat a wellbore creates logistical issues to achieve the desired result. Additionally, the cost is magnified when the hydraulic fracturing treatment is conducted on a deep wellbore. In this situation, jointed pipe is typically required in conjunction with the coiled tubing to reach the area of interest in the deep wellbore. By deploying jointed pipe in the wellbore, additional costly equipment is required to maintain well control, such as a snubbing unit which is well known in the art. Furthermore, another problem associated with using the hydraulic fracturing treatment is related to the degree of control of limiting the treatment to a selected region of the wellbore. It is often difficult for the operator to ensure that the fracturing fluid is only used to treat the selected region of the wellbore.

There is a need, therefore, for controlling the hydrostatic head in the wellbore to prevent the killing of the well upon the completion of the hydraulic fracturing treatment. There is a further need for a method for limiting the treatment to a specific region of the wellbore. There is yet a further need for a cost effective method to increase the productivity of an existing well.

SUMMARY OF THE INVENTION

The present invention generally relates to a method and an apparatus for stimulating the production of an existing well. In one aspect, a method of treating a well is provided. The method includes inserting a selective treatment assembly and a plug assembly into a partially lined wellbore until the selective treatment assembly is positioned proximate an area of interest. Thereafter, the selective treatment assembly is activated to isolate and treat the area of interest. After the area is treated, the selective treatment assembly is deactivated and the selective treatment assembly and the plug assembly are urged toward the surface of the well until the plug assembly is seated in a polished bore receptacle located at a lower end of a string of casing. At this point, the treated portion of the wellbore is isolated from the untreated portion. Thereafter, the pressure in the untreated portion of the wellbore is equalized with the surface of the well and then the selective treatment assembly is removed from the wellbore while the plug assembly remains in the polished bore receptacle. Next, a string of production tubing is disposed in the wellbore and attached to the polished bore receptacle. Thereafter, the plug assembly is removed from the polished bore receptacle and the well is produced.

In another aspect an apparatus for treating a portion of a wellbore is provided. The apparatus includes a selective treatment assembly having a treatment portion with injecting ports and a selectively settable seal assembly at each end thereof. The apparatus further includes a plug assembly secured to the selective treatment assembly by a releasable mechanical connection.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

The present invention generally relates to a method and an apparatus for performing a treatment operation in a well. In one aspect, a method is provided for treating a specific region of a wellbore. In another aspect, a method is provided for controlling the hydrostatic head in the wellbore after the operation is complete.

Figure 1:
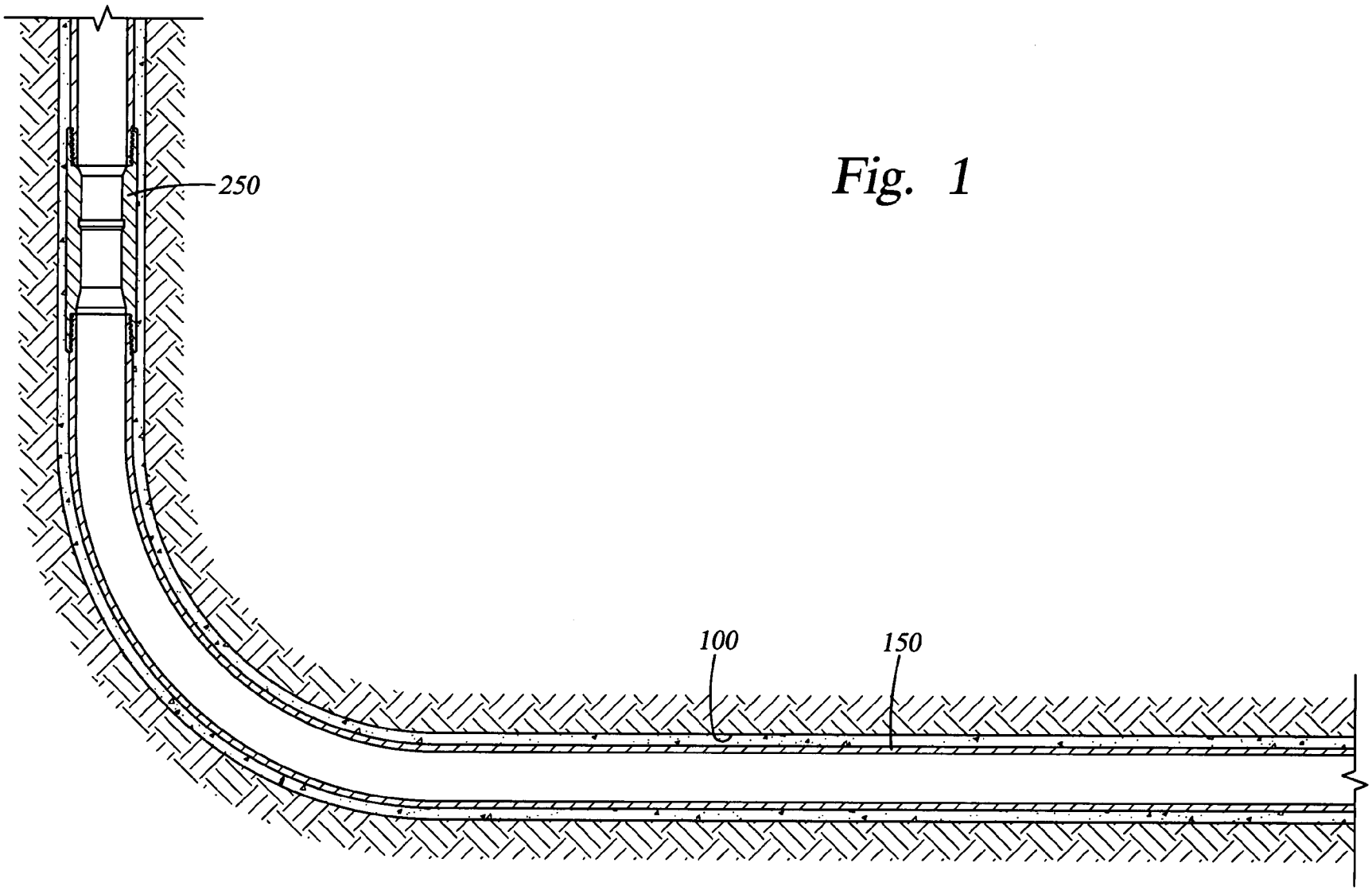
FIG. 1 is a cross-sectional view illustrating a string of casing disposed in a wellbore.

FIG. 1 is a cross-sectional view illustrating a string of casing 150 disposed in a wellbore 100. As illustrated, the wellbore 100 includes a vertical portion and horizontal portion. It should be noted, however, that the invention is not limited to this arrangement but may also be used in other wellbore arrangements such as a vertical wellbore or a deviated wellbore As illustrated on FIG. 1, the string of casing 150 includes a PBR 250 formed therein. PBR is an abbreviation for a "polished bore receptacle" and is generally used to facilitate the landing of production tubing into a string of casing. In the present invention, the PBR 250 is formed in the string of casing 150 prior to inserting into the wellbore 100. Thereafter, the string of casing 150 is inserted into the wellbore 100 until the PBR 250 is located proximate the horizontal portion of the wellbore 100. The string of casing 150 is then secured in the wellbore 100 by a cementing operation.

Figure 2:
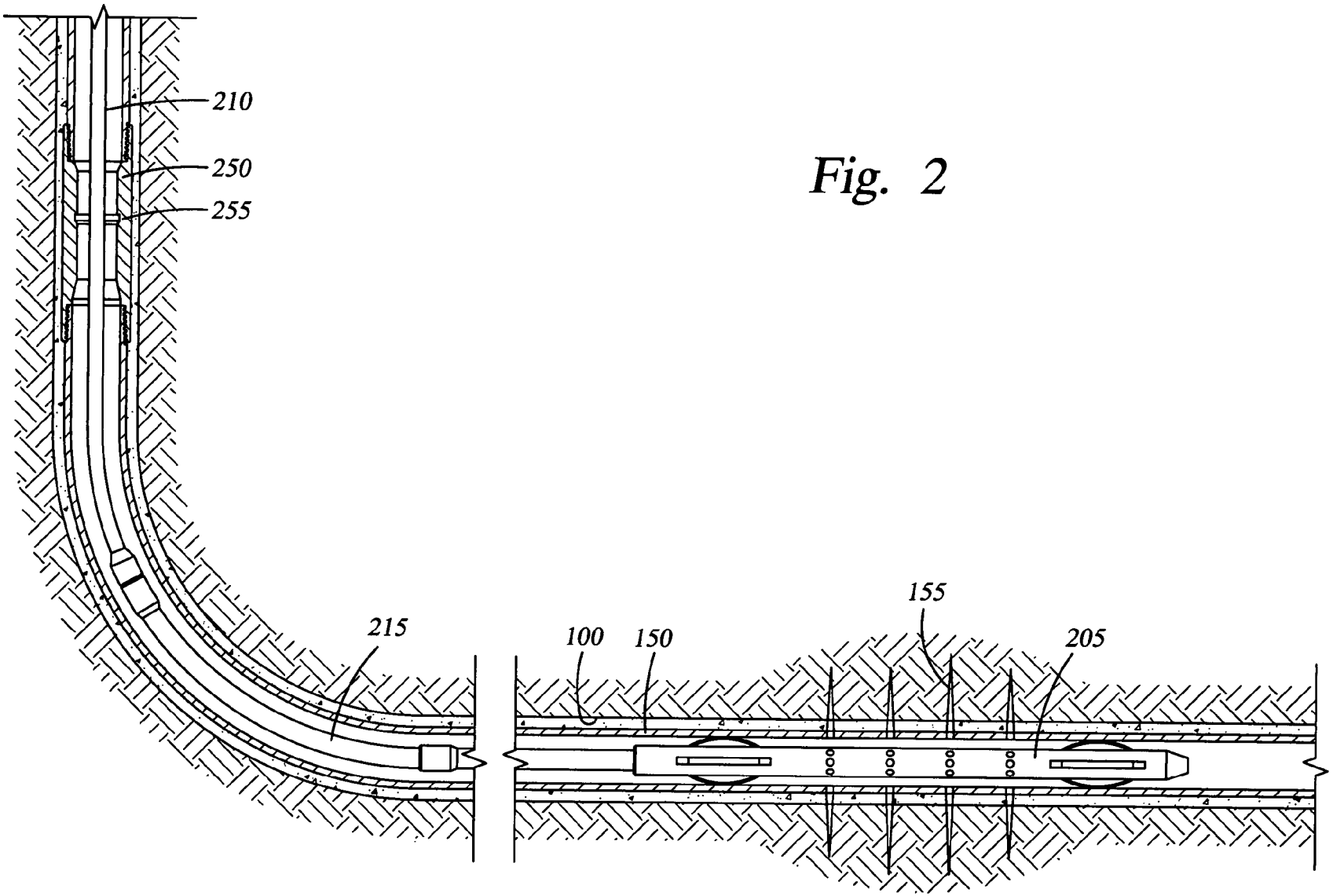
FIG. 2 is a cross-sectional view illustrating a perforating gun disposed adjacent an area of interest where treatment is desired.

FIG. 2 is a cross-sectional view illustrating a perforating gun 205 disposed adjacent an area of interest where treatment is desired. Generally, the perforating gun 205 is disposed in the wellbore 100 attached to the lower end of a string of jointed pipe 215 and a string of coil tubing 210 to a location proximate the area of interest. It should be understood, however, that the present invention is not limited to this arrangement of deploying the perforating gun 205. For instance, the coiled tubing 210 may be used exclusively if there is sufficient length to dispose the perforating gun 205 proximate the area of interest.

Subsequently, the perforating gun 205 is actuated to create a plurality of perforations 155 in the casing 150, thereby exposing the area of interest or formation. Thereafter, the perforating gun 205 may be moved to another location in the wellbore 100 to perforate or make a hole in that location. This sequence is then repeated until the entire string of casing 150 includes perforated holes at every area of interest where treatment is desired. The perforating gun 205 is then removed and the wellbore 100 is treated as will be discussed in FIG. 3.

Figure 3:
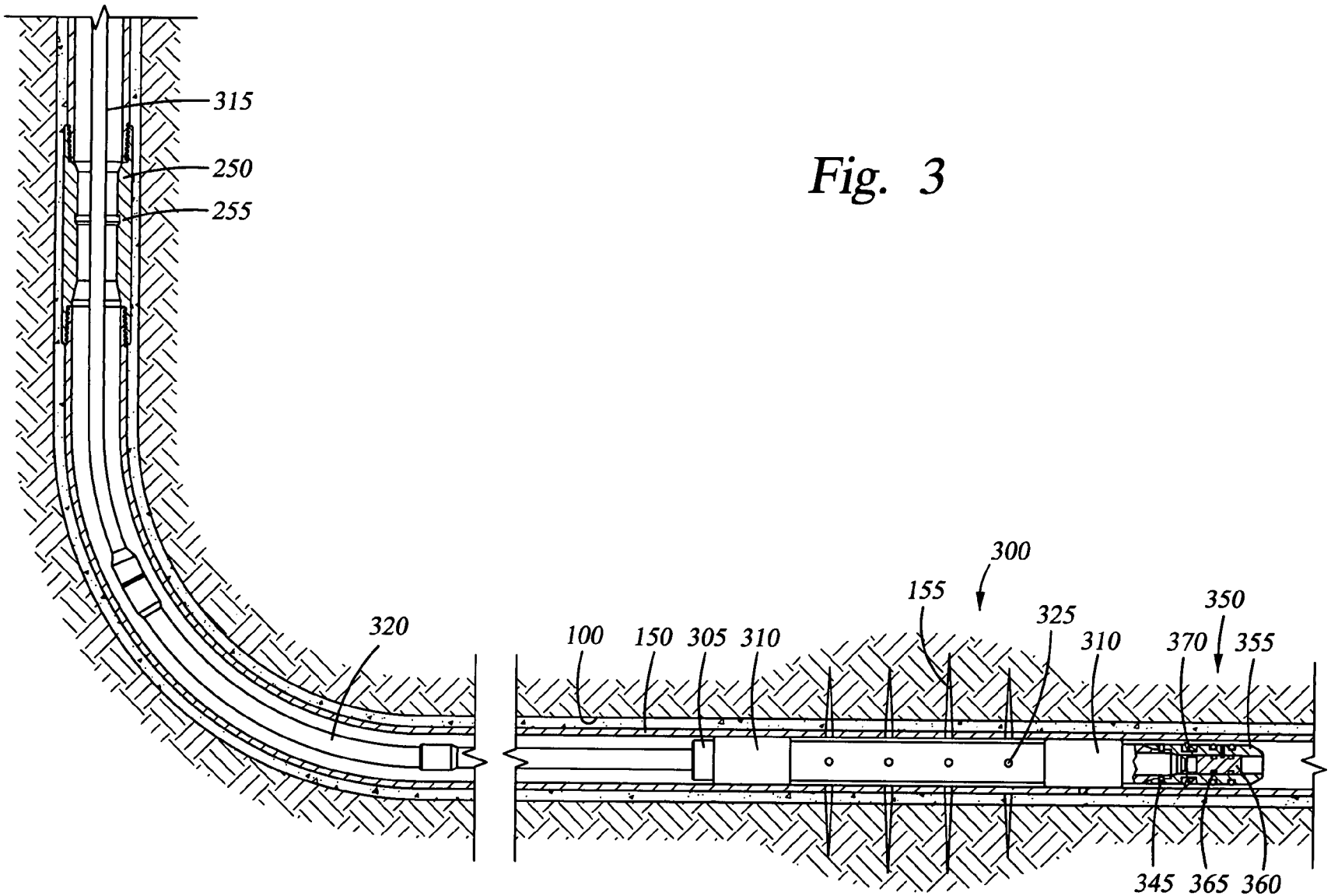
FIG. 3 is a cross-sectional view illustrating the treatment of the area of interest by a selective treatment assembly.

FIG. 3 is a cross-sectional view illustrating the area of interest being treated by a selective treatment assembly 300. Generally, the selective treatment assembly 300 and a plug assembly 350 are disposed in the wellbore 100 to a predetermined location below the PBR 250. The selective treatment assembly 300 is a pack-off system used for isolating an area of interest in the wellbore 100. An exemplary pack-off system is described in U.S. Pat. No. 6,253,856, issued to Ingram et al. on Jul. 3, 2001, which is herein incorporated by reference in its entirety. In its most basic form, the selective treatment assembly 300 includes two spaced apart selectively settable packing elements 310 disposed on a body 305. Typically, the unactuated selective treatment assembly 300 is run into the wellbore 100 on coiled tubing 315 and a string of jointed pipe 320 until the packing elements 310 straddle the area of interest in the wellbore 100. It should be understood, however, that the present invention is not limited to this arrangement of deploying the selective treatment assembly 300. For instance, the coiled tubing 315 may be used exclusively if there is sufficient length to dispose the unactuated selective treatment assembly 300 proximate the area of interest.

Thereafter, the packing elements 310 are set and the area of interest is sealed off from the remaining portion of the wellbore 100. Thereafter, a specially engineered fluid from the surface of the well is pumped through the coiled tubing 315 and jointed pipe 320 into the selective treatment assembly 300. The specially engineered fluid exits a plurality of ports 325 formed in the body 305 to treat the area of interest. In this respect, the area of interest is treated without affecting the remaining portion of the wellbore 100. After treatment of that specific area of interest is complete, the sealing elements 310 are unset and the selective treatment assembly 300 is moved to another area of interest to treat that area in the same manner. This sequence is repeated until each area of interest is treated.

As illustrated in FIG. 3, the plug assembly 350 is disposed at the lower end of the selective treatment assembly 300. In the embodiment shown, the plug assembly 350 includes a body 355 with a plurality of seals 365 disposed therearound and an inner plug 360 disposed therein. The body 355 further includes an x-lock style profile 370 disposed on the outer surface thereof. The plug assembly 350 is secured to the selective treatment assembly 300 by a releasable mechanical connection 345 such as a shear pin. Generally, the shear pin is a short piece of brass or steel that is used to retain sliding components in a fixed position until a sufficient force is applied causing the pin to fail. Once the pin fails, the components can then move as two separate units. In the present case, the releasable mechanical connection 345 is used to temporarily connect the plug assembly 350 to the selective treatment assembly 300 until an axial force is applied to plug assembly 350. At that time, the mechanical connection 345 allows the plug assembly 350 to separate from the selective treatment assembly 300.

Figure 4:
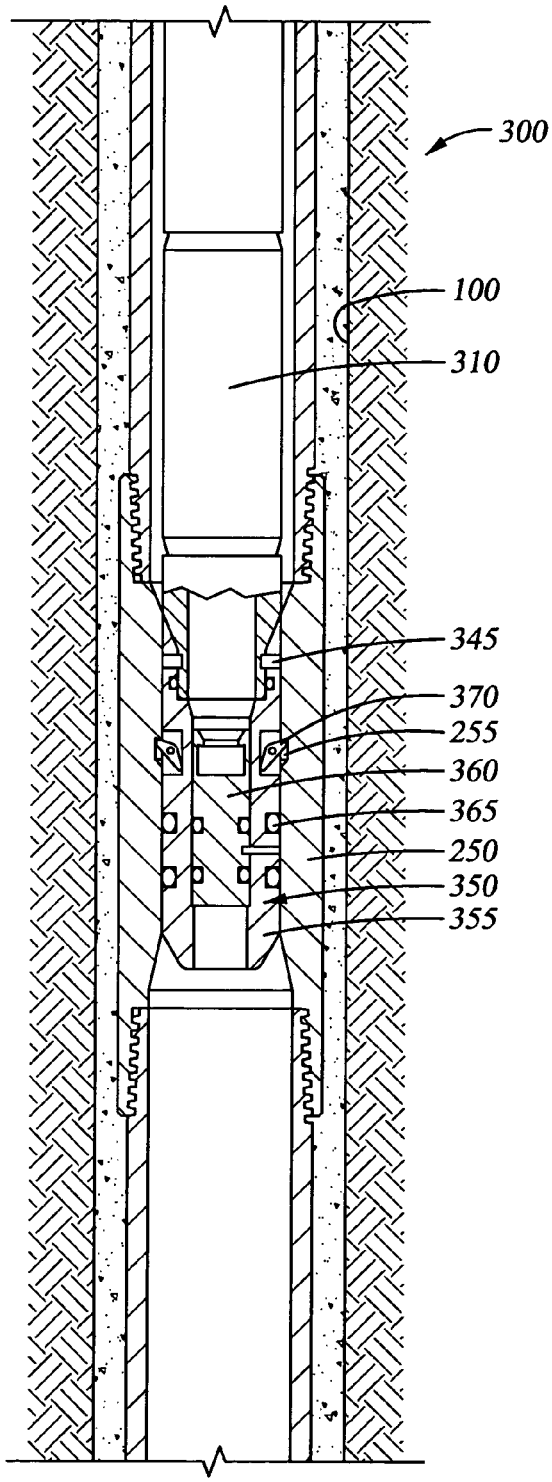
FIG. 4 is a cross-sectional view illustrating a plug assembly seated in a PBR.

FIG. 4 is a cross-sectional view illustrating the plug assembly 350 seated in the PBR 250. After the treatment of each area of interest, the selective treatment assembly 300 and plug assembly 350 are pulled toward the surface of the wellbore 100 by the coil tubing 315 and the jointed pipe 320. The movement progresses until the plug assembly 350 reaches the PBR 250. At that time, the profile 370 on the plug assembly 350 locks into a nipple section 255 of the PBR 250 to restrict any further movement of the plug assembly 350. Additionally, the plurality of seals 365 around the plug assembly 350 will form a fluid tight relationship with an inner portion of the PBR 250.

Figure 5:
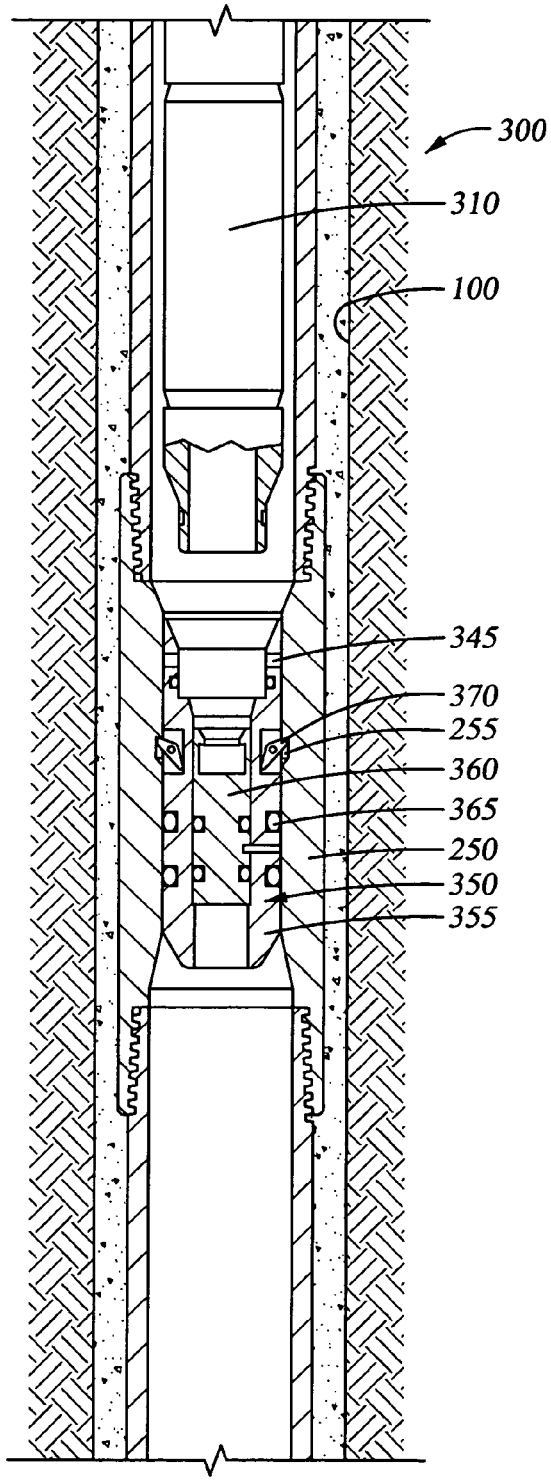
FIG. 5 is a cross-sectional view illustrating the removal of the selective treatment assembly from the wellbore.

FIG. 5 is a cross-sectional view illustrating the removal of the selective treatment assembly 300 from the wellbore 100. As the selective treatment assembly 300 is urged further toward the surface of the wellbore 100, the releasable mechanical connection 345 fails, thereby allowing the plug assembly 350 to separate from the selective treatment assembly 300. Thus, permitting the plug assembly 350 to remain downhole in the PBR 250 while the selective treatment assembly 300 continues to be moved toward the surface of the wellbore 100. In this respect, the plug assembly 350 separates and seals a treated portion of the wellbore 100 below the PBR 250 from an untreated portion of the wellbore 100 above the PBR 250. Thereafter, the pressure in the untreated portion of the wellbore 100 is bled down to 0 Psi, thereby allowing the jointed pipe 320 connected to the selective treatment assembly 300 to be removed without the use of a snubbing unit.

Figure 6:
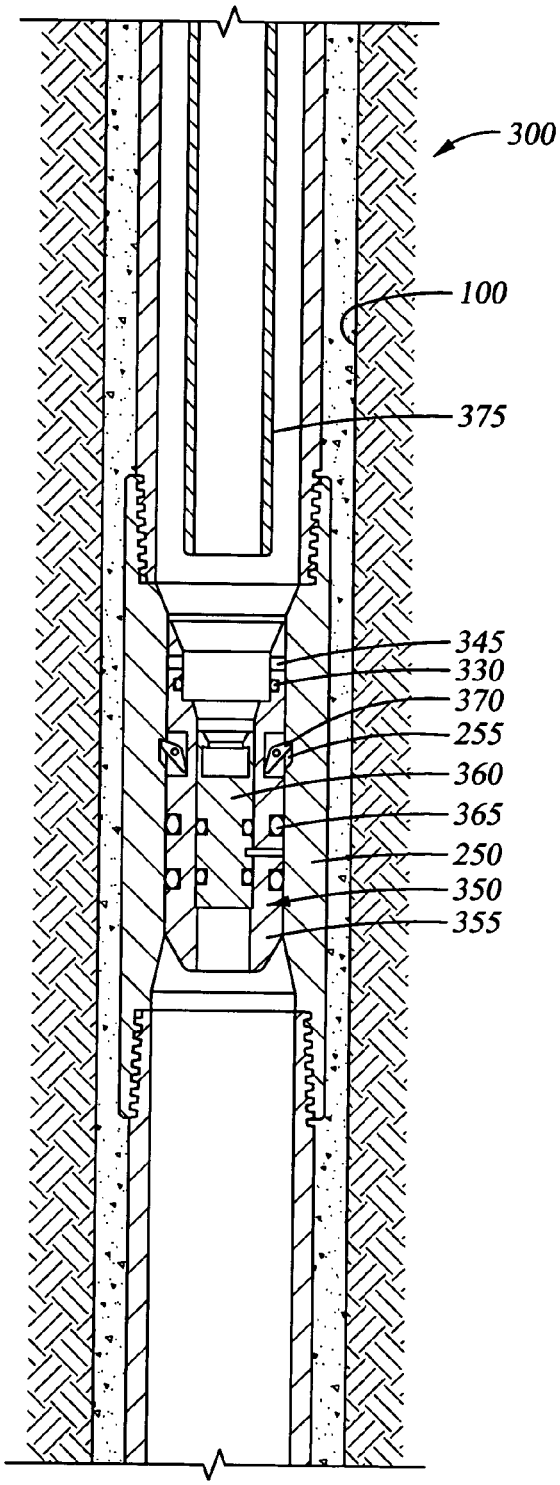
FIG. 6 is a cross-sectional view illustrating a string of production tubing stung in an upper portion of the plug assembly.

FIG. 6 is a cross-sectional view illustrating a string of production tubing 375 disposed in the wellbore 100 and connected to the upper portion of the plug assembly 350. After the selective treatment assembly 300 is removed from the wellbore 100, the coil tubing unit at the surface of the wellbore 100 is typically removed from the wellsite and a working rig (not shown) is constructed to deploy the production tubing 375. Generally, the production tubing 375 is lowered into the wellbore 100 until a lower end of the production tubing 375 is stung into the upper portion of the plug assembly 350. Subsequently, a plurality of seals 330 create a fluid seal between the production tubing 375 and the plug assembly 350.

Figure 7:
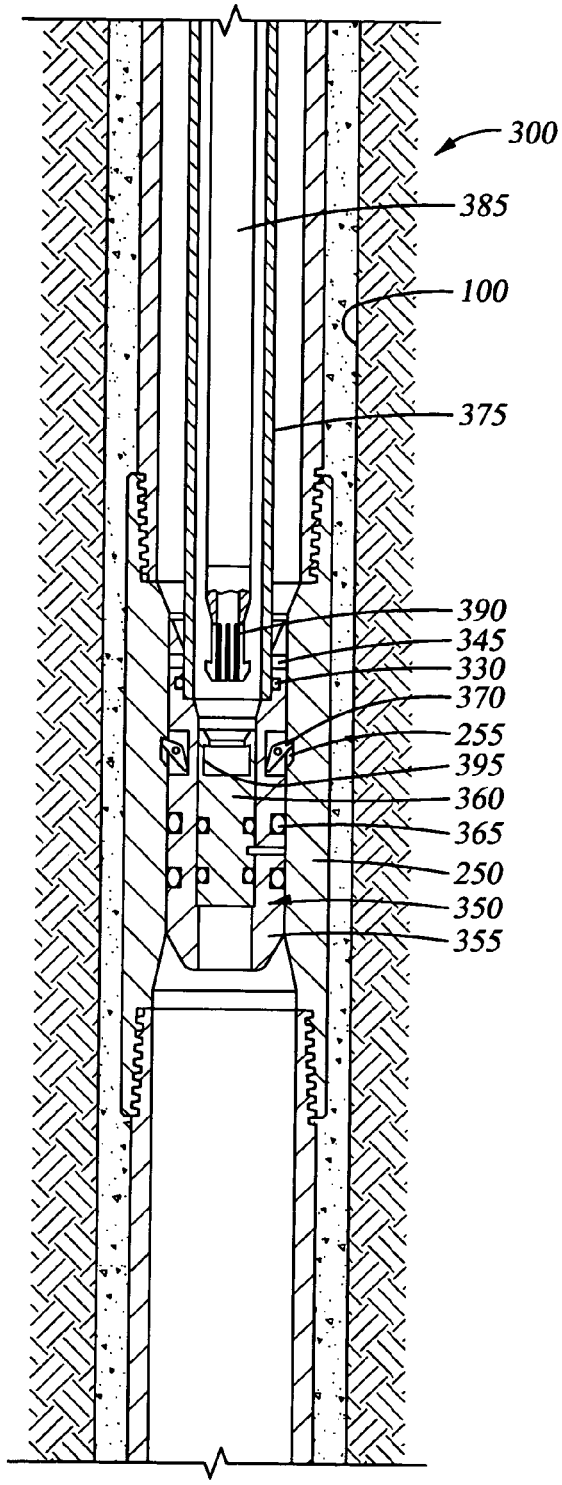
FIG. 7 is a cross-sectional view illustrating a retrieval tool disposed in the string of production tubing to retrieve an inner plug.

FIG. 7 is a cross-sectional view illustrating a retrieval tool 390 disposed in the string of production tubing 375 to retrieve the inner plug 360. After the production tubing 375 is sealed in the plug assembly 350, a slick line 385 with the retrieval tool 390 disposed at the lower end thereof is inserted through a seal rubber (not shown) at the upper end of the wellbore 100. The retrieval tool 390 is lowered into the production tubing 375 until it contacts an inner profile 395 formed on an upper portion of the inner plug 360.

Figure 8:
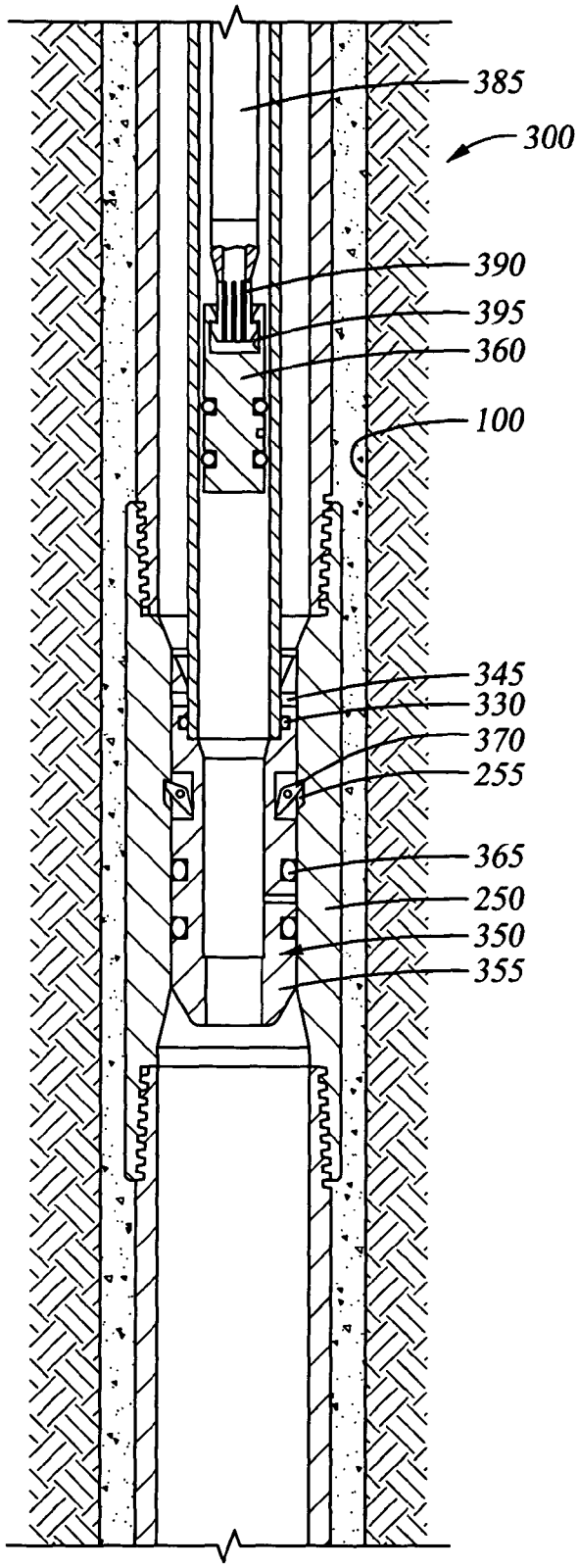
FIG. 8 is a cross-sectional view illustrating the removal of the inner plug from the plug assembly.

FIG. 8 is a cross-sectional view illustrating the removal of the inner plug 360 from the plug assembly 350. After the retrieval tool 390 is located adjacent the plug assembly 350, the retrieval tool 390 is activated allowing the tool 390 to attach to the profile 395. Next, the slick line 385 and the retrieval tool 390 are pulled toward the surface of the wellbore 100 thereby pulling the inner plug 360 out of the plug assembly 350. The removal of the inner plug 360 from the plug assembly 350 removes the sealed barrier between the treated portion and the untreated portion of the wellbore 100. It should be noted that the untreated portion of the wellbore 100 has 0 Psi prior to removal of the inner plug 360, therefore upon removal of the inner plug 360 the treated portion of the wellbore below the PBR 250 will not be affected by the pressure in the untreated portion of the wellbore 100. In this manner, the treated portion of the wellbore 100 may be stimulated by the treatment as discussed without damaging the newly formed fractures by the fluid pressure in the untreated portion of the wellbore 100. In an alternative embodiment, the plug assembly 350 may be constructed and arranged as a single unit without an inner plug 360 disposed therein, thereby requiring the entire plug assembly 350 to be removed from the PBR 250.

Figure 9:
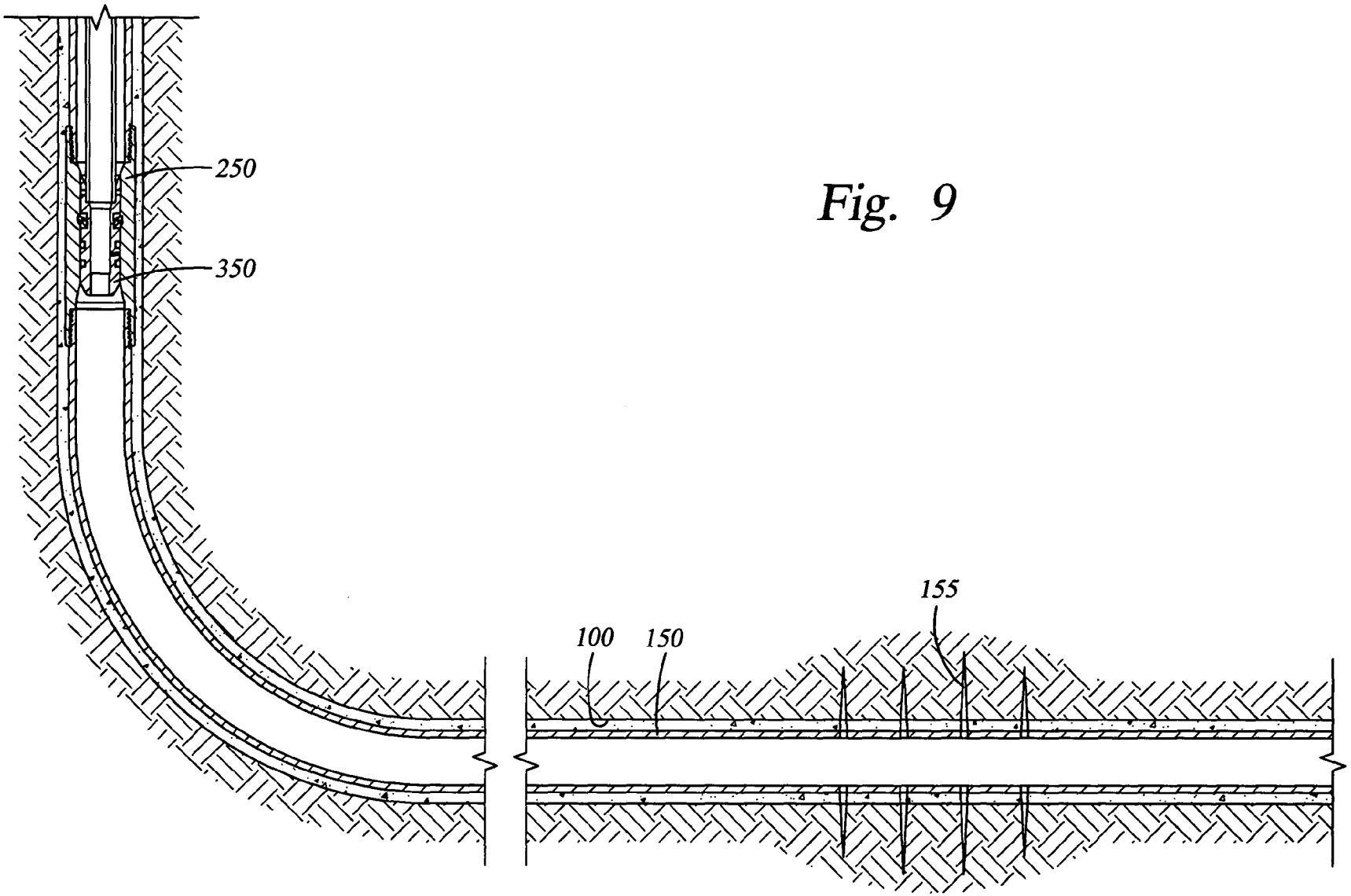
FIG. 9 is a cross-sectional view illustrating the completed wellbore.

FIG. 9 is a cross-sectional view illustrating the completed wellbore 100. As shown, the inner plug 360 has been removed from the plug assembly 350, thereby removing the barrier between the treated portion and the untreated portion of the wellbore 100. Thus, formation fluid from the surrounding formations flows through the perforations into the wellbore 100. Subsequently, the formation fluid is communicated through the plug assembly 350 and the production tubing 375 to the surface of the wellbore 100.

In operation, the selective treatment assembly and the plug assembly are inserted into the partially lined wellbore until the selective treatment assembly is positioned proximate the area of interest. Subsequently, the selective treatment assembly is activated to isolate and treat the area of interest. After the area is treated, the selective treatment assembly is deactivated and the selective treatment assembly and the plug assembly are urged toward the surface of the well until the plug assembly is seated in a polished bore receptacle disposed in the string of casing. At this point, the treated portion of the wellbore is separated from the untreated portion. Thereafter, the pressure in the untreated portion of the wellbore is relieved and then the selective treatment assembly is removed from the wellbore while the plug assembly remains in the polished bore receptacle. Next, a string of production tubing is disposed in the wellbore and attached to the polished bore receptacle. Thereafter, the plug assembly is removed from the polished bore receptacle and the well is produced.

In an alternative embodiment, the selective treatment assembly 200 is employed as a pressure operation member for performing a pressure operation in a wellbore. During the pressure operation, the pressure operation member is disposed in the wellbore by a conveyance member, such as a coiled tubing. The pressure operation member is located adjacent a first zone, a desired location, in the wellbore while the conveyance member is located in a second zone. Thereafter, the fluid pressure is changed in a first wellbore portion adjacent the first zone. Subsequently, the pressure operation member is removed from adjacent the first zone without killing the first zone and then another completion operation is commenced.

While the foregoing is directed to embodiments of the present invention, other and further embodiments of the invention may be devised without departing from the basic scope thereof, and the scope thereof is determined by the claims that follow.

The invention claimed is:

1. A method of treating a well, comprising:

positioning a selective treatment assembly with a plug assembly in a wellbore proximate an area of interest, the selective treatment assembly having a treatment portion;

treating the area of interest;

isolating a treated portion of the wellbore from an untreated portion by latching the plug assembly in a profile in the wellbore as the treatment portion of the selective treatment assembly is removed from the wellbore;

equalizing the pressure between the untreated portion of the wellbore and the surface of the well; and completing the well.

2. The method of claim 1, further including activating a seal assembly on the treatment portion to isolate the area of interest.

3. The method of claim 2, further including deactivating the seal assembly and urging the selective treatment assembly toward the surface of the well.

4. The method of claim 1, further including pumping fluid through a plurality of injecting ports on the treatment portion to treat the area of interest.

5. The method of claim 1, wherein the profile is formed in a polished bore receptacle disposed in a string of casing.

6. The method of claim 5, further including disposing a string of production tubing in the wellbore and attaching it to the polished bore receptacle.

7. The method of claim 5, further including positioning a retrieval tool adjacent the plug assembly and removing the plug assembly from the polished bore receptacle.

8. The method of claim 1, further including positioning a perforating gun proximate the area of interest and perforating a string of casing.

9. The method of claim 1, wherein the plug assembly is secured to the lower end of the selective treatment assembly by a mechanical connection.

10. The method of claim 9, further including releasing the mechanical connection to separate the plug assembly from the selective treatment assembly.

11. The method of claim 10, wherein the mechanical connection is a shear pin.

12. The method of claim 1, wherein the plug assembly includes an x-lock profile formed on the outer surface thereof.

13. The method of claim 12, further including seating the x-lock profile on the plug assembly in the profile formed in a polished bore receptacle.

14. The method of claim 1, wherein the selective treatment assembly is inserted into the wellbore by coiled tubing.

15. The method of claim 1, wherein the selective treatment assembly is inserted into the wellbore by coiled tubing and a string of jointed pipe.

16. The method of claim 1, further including moving the selective treatment assembly to a second area of interest to isolate and treat the second area of interest.

17. A method of treating a well, comprising:

inserting a selective treatment assembly with a plug assembly disposed at a lower end thereof into a wellbore that is at least partially lined with casing;

positioning the selective treatment assembly proximate an area of interest;

isolating and treating the area of interest by activating the selective treatment assembly;

deactivating the selective treatment assembly and urging the selective treatment assembly and the plug assembly toward the surface of the well;

isolating a treated portion of the wellbore from an untreated portion by latching the plug assembly in a profile in the wellbore as the selective treatment assembly is removed from the treated portion of the wellbore;

equalizing the pressure between the untreated portion of the wellbore and the surface of the well;

removing the selective treatment assembly from the wellbore;

removing the plug assembly; and producing the well.

18. The method of claim 17, further including positioning a perforating gun proximate the area of interest and perforating the casing.

19. The method of claim 17, further including disposing a string of production tubing in the wellbore and attaching it to an area above the profile formed in a polished bore receptacle.

20. The method of claim 17, further including positioning a retrieval tool adjacent the plug assembly.

21. The method of claim 17, further including releasing a mechanical connection that secures the plug assembly to the selective treatment assembly.

22. The method of claim 17, wherein the selective treatment assembly and the plug assembly are inserted into the wellbore by coiled tubing.

23. The method of claim 17, wherein the selective treatment assembly and the plug assembly are inserted into the wellbore by coiled tubing and a string of jointed pipe.

* * * * *